US009877619B1

(12) United States Patent
Diaz

(10) Patent No.: US 9,877,619 B1
(45) Date of Patent: Jan. 30, 2018

(54) SPONGE APPARATUS

(71) Applicant: Victor Diaz, Perris, CA (US)

(72) Inventor: Victor Diaz, Perris, CA (US)

( * ) Notice: Subject to any disclaimer, the term of this patent is extended or adjusted under 35 U.S.C. 154(b) by 0 days.

(21) Appl. No.: 15/344,018

(22) Filed: Nov. 4, 2016

(51) Int. Cl.
*A47K 7/03* (2006.01)

(52) U.S. Cl.
CPC ..... *A47K 7/03* (2013.01)

(58) Field of Classification Search
CPC combination set(s) only.
See application file for complete search history.

(56) References Cited

U.S. PATENT DOCUMENTS 5,215,106 A * 6/1993 Choi ..... A45D 19/02 132/109
5,704,723 A * 1/1998 Salisian ..... A47K 7/03 401/201
7,165,907 B2 * 1/2007 Levy ..... A46B 5/06 401/183
7,318,682 B2 * 1/2008 Anderson ..... A45D 34/06 401/183
7,419,321 B2 * 9/2008 Tereschouk ..... A45D 34/04 401/132
7,419,322 B2 * 9/2008 Laflamme ..... A47K 5/1208 222/372
7,645,084 B1 * 1/2010 Schulte ..... A47K 7/02 401/183

* cited by examiner

*Primary Examiner* — David Walczak
(74) *Attorney, Agent, or Firm* — RG Patent Consulting, LLC; Rachel Gilboy

(57) ABSTRACT

An improved sponge apparatus is a body washing sponge device with a liquid soap reservoir, which automatically releases liquid soap in controlled amounts onto the sponge-like material through apertures in the main body, and is able to be used multiple times before refilling the reservoir.

9 Claims, 4 Drawing Sheets

REPLACEMENT SHEET

SPONGE APPARATUS

COPYRIGHT NOTICE

A portion of the disclosure of this patent document contains material which is subject to copyright protection. The copyright owner has no objection to the facsimile reproduction by anyone of the patent document or the patent disclosure, as it appears in the Patent and Trademark Office patent file or records, but otherwise reserves all copyright rights whatsoever. 37 CFR 1.71(d).

BACKGROUND OF THE INVENTION

The following includes information that may be useful in understanding the present invention(s). It is not an admission that any of the information provided herein is prior art, or material, to the presently described or claimed inventions, or that any publication or document that is specifically or implicitly referenced is prior art.

1. Field of the Invention

The present invention relates generally to the field of sponge body washing devices and more specifically relates to an improved sponge-like body washing device with an internal chamber for holding body washing fluid, which dispenses through the main body and onto the sponge when in use.

2. Description of the Related Art

A sponge is a tool or cleaning aid consisting of soft, porous material. Sponges are usually used for cleaning impervious surfaces. They are especially good at absorbing water and water-based solutions. Sponges are commonly made from cellulose wood fibers or foamed plastic polymers. Some natural sponges are still sold, but most are now used either as body or facial sponges (bath sponges) or as tools for sponge painting. Bath sponges help cleanse the skin by scraping away the dead skin and washing away dirt.

The three other categories of widely available synthetic sponges are low-density polyether (known as non-absorbent sponges), PVA (a highly absorbent material for use in medicine, and polyester. Polyester sponges are subdivided into a variety of types, some of which are reticulated (artificially broken-in) for ease of use. One type, double-blown polyester, has high water-retention ability approaching or equaling that of PVA sponges, but with visible pores and more diverse uses.

Bathing sponges have been in use for many years, but have gained popularity in recent years. A method of using a bathing sponge typically consists of pouring liquid soap onto the sponge-like material, or directly on the body, then scrubbing the body with the sponge-like material. This requires locating the liquid soap bottle while in the shower, opening the bottle, applying the liquid onto the sponge, then closing the bottle and replacing it onto the shelf. This process is inconvenient at best, and can be dangerous if the soap bottle slips out of the users hand and onto the bath floor.

Various attempts have been made to solve the above-mentioned problems such as those found in U.S. Pat. No. 6,368,003 to Roger Lynn Sorrell; U.S. Pat. No. 8,002,486 to Hong D. Tran; U.S. Pat. No. 5,916,586 to Virgilio Villa; U.S. Pat. No. 5,944,032 to Kelly Ann Masterson; and U.S. Publication No. 2010/0147892 to Roger J. LaFlamme. This art is representative of body washing devices. None of the above inventions and patents, taken either singly or in combination, is seen to describe the invention as claimed.

Ideally, a body washing device should provide excellent exfoliating properties, ease of use, and yet would operate reliably and be manufactured at a modest expense. Thus, a need exists for a reliable improved sponge apparatus to avoid the above-mentioned problems.

BRIEF SUMMARY OF THE INVENTION

In view of the foregoing disadvantages inherent in the known body washing device art, the present invention provides a novel improved sponge apparatus. The general purpose of the present invention, which will be described subsequently in greater detail is to provide an improved body washing sponge device with a liquid soap reservoir, which automatically releases liquid soap in controlled amounts onto the sponge-like material through apertures in the main body, and is able to be used multiple times before refilling the reservoir.

An improved sponge apparatus comprising a rubber and resilient main body including a top wall having a plurality of water drain holes aligned in a spaced circular pattern therethrough, a refill aperture, an elongated refill cap member for covering the refill aperture, a bottom wall having a plurality of water drain holes therethrough, and a side wall. The top wall, bottom wall, and side wall form a hollow interior, with the resilient liquid soap reservoir which is also made of rubber, located within the hollow interior of the main body.

The resilient liquid soap reservoir includes a top wall having a refill aperture therethrough, and an elongated refill cap member extending downwardly from the refill aperture within the top wall of the main body, and connecting with the refill aperture of the liquid soap reservoir, to seal the liquid soap reservoir when connected.

The bottom wall includes at least one exit hole shaped, sized, and adapted to prevent liquid soap from within the liquid soap reservoir from passing through until a user squeezes and deforms the main body and the reservoir, thereby forcing a portion of the liquid soap through the aperture. It further has a sponge member connected to a bottom surface of the bottom wall of the main body, and is adapted to retain water and liquid soap therein. The sponge member is formed from a porous fabric material with a plurality of folds adapted to retain water and liquid soap, and release water and liquid soap when the main body is squeezed.

Liquid soap can be placed within the liquid soap reservoir via a refill cap member having a handle member connected thereto via interdigitating threads, and when in use the improved sponge apparatus is adapted to allow water to pass through the water drain holes of the main body and into the sponge member while a user squeezes a desired amount of liquid soap out of the liquid soap reservoir and into the sponge member to mix with water for use. The improved sponge apparatus further has a flexible wrist wrap member formed from string material, connected to the main body and adapted to be placed around a user's wrist when the improved sponge apparatus is in use. The main body is formed having an undulated shape around its circumference, making the main body easily gripped and squeezed by a user.

The present invention holds significant improvements and serves as an improved sponge apparatus. For purposes of summarizing the invention, certain aspects, advantages, and novel features of the invention have been described herein. It is to be understood that not necessarily all such advantages may be achieved in accordance with any one particular embodiment of the invention. Thus, the invention may be embodied or carried out in a manner that achieves or optimizes one advantage or group of advantages as taught herein without necessarily achieving other advantages as may be taught or suggested herein. The features of the invention which are believed to be novel are particularly pointed out and distinctly claimed in the concluding portion of the specification. These and other features, aspects, and advantages of the present invention will become better understood with reference to the following drawings and detailed description.

BRIEF DESCRIPTION OF THE DRAWINGS

The figures which accompany the written portion of this specification illustrate embodiments and method(s) of use for the present invention, improved sponge apparatus constructed and operative according to the teachings of the present invention.

The various embodiments of the present invention will hereinafter be described in conjunction with the appended drawings, wherein like designations denote like elements.

DETAILED DESCRIPTION

As discussed above, embodiments of the present invention relate to an body washing device and more particularly to an improved sponge apparatus as used to improve the ability of a user to fill the reservoir of the main body with liquid soap and take multiple showers before refilling the reservoir.

Generally speaking, an improved sponge apparatus is a body washing sponge device with a liquid soap reservoir, which automatically releases liquid soap in controlled amounts onto the sponge-like material through apertures in the main body, and is able to be used multiple times before refilling the reservoir.

Figure 1:
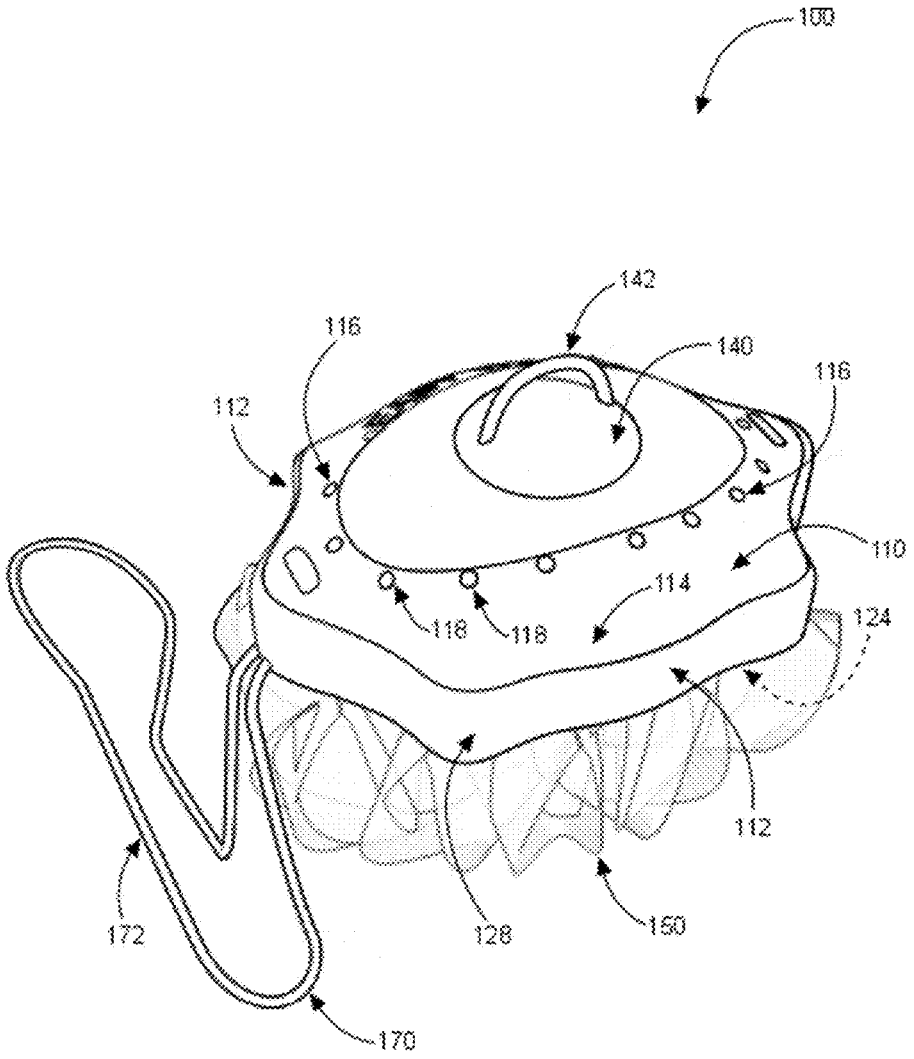
FIG. 1 shows a perspective view illustrating an improved sponge apparatus according to an embodiment of the present invention.

Referring to the drawings by numerals of reference there is shown in FIG. 1, a perspective view illustrating an improved sponge apparatus 100 according to an embodiment of the present invention.

An improved sponge apparatus 100 comprising rubber 112 and resilient main body 110 including top wall 114 having a plurality of water drain holes 116 aligned in a spaced circular pattern 118 therethrough, refill aperture 136, an elongated refill cap member 140 for covering refill aperture 136, bottom wall 124 having a plurality of water drain holes 116 therethrough, and side wall 128. Top wall 114, bottom wall 124, and side wall 128 form hollow interior 132, with the resilient liquid soap reservoir 200 which is also made of rubber 206, located within hollow interior 132 of main body 110.

Figure 2:
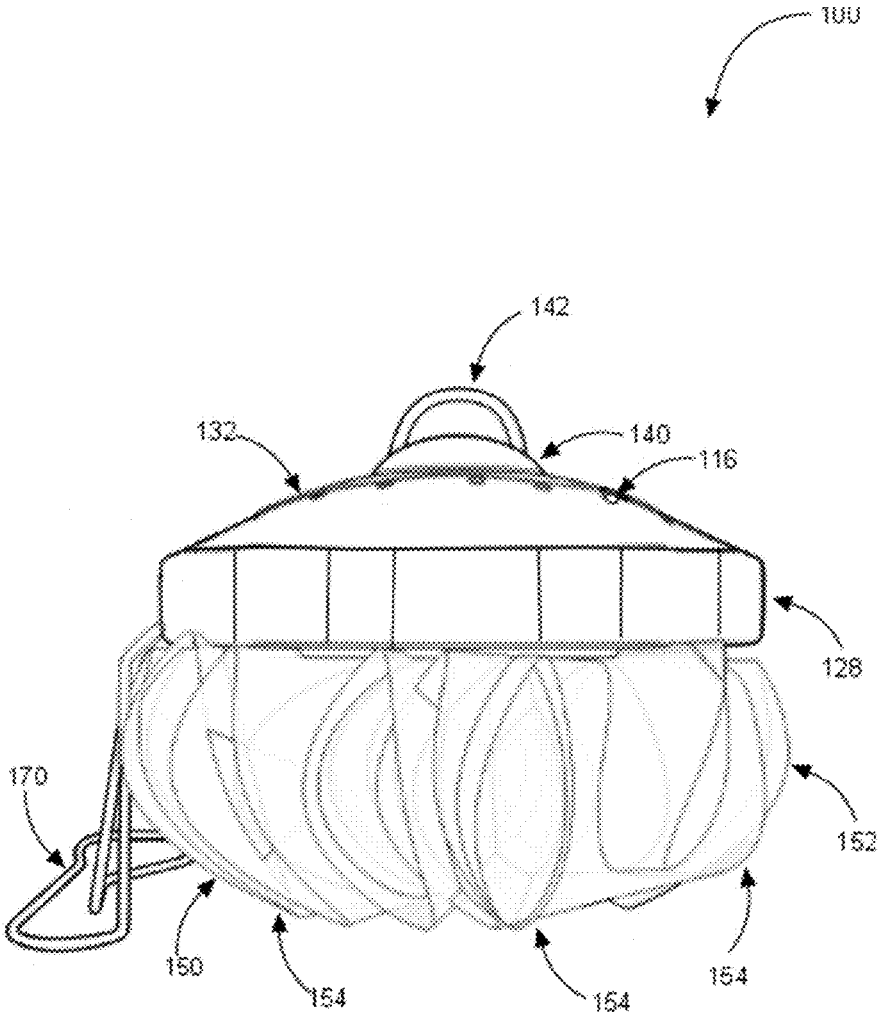
FIG. 2 is a side view illustrating an improved sponge apparatus according to an embodiment of the present invention of FIG. 1.

Referring now to FIG. 2, a side view illustrating an improved sponge apparatus 100 according to an embodiment of the present invention.

The resilient liquid soap reservoir 200 includes top wall 210 having refill aperture 212 therethrough, and an elongated refill cap member 140 extending downwardly from refill aperture 136 within top wall 114 of main body 110, and connecting with refill aperture 212 of the liquid soap reservoir 200, to seal liquid soap reservoir 200 when connected.

Figure 3:
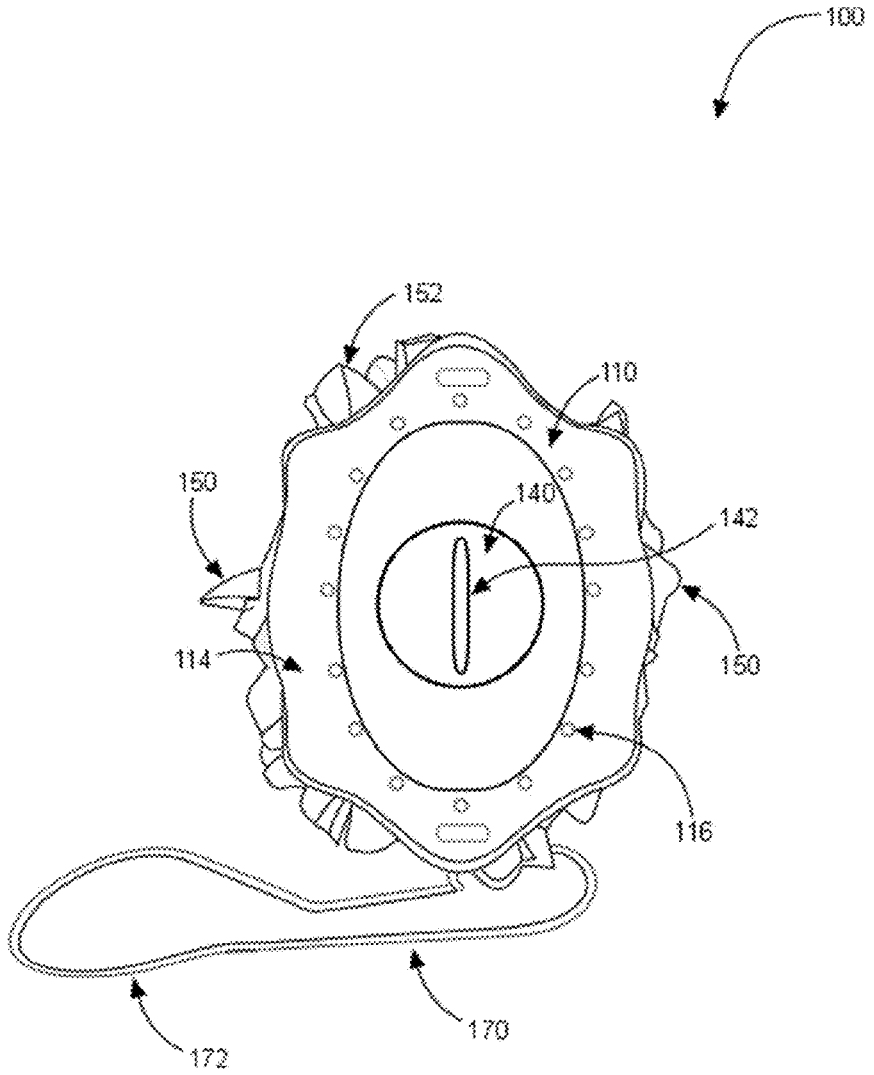
FIG. 3 is a top view illustrating improved sponge apparatus according to an embodiment of the present invention of FIG. 1.

Referring now to FIG. 3, a top view illustrating an improved sponge apparatus 100 according to an embodiment of the present invention.

Bottom wall 216 includes at least one exit hole 218 shaped, sized, and adapted to prevent liquid soap 230 from within liquid soap reservoir 200 from passing through until a user squeezes and deforms main body 110 and liquid soap reservoir 200, thereby forcing a portion of liquid soap 230 through exit hole 218. It further has sponge member 150 connected to bottom surface 126 of bottom wall 124 of main body 110, and is adapted to retain water and liquid soap therein. Sponge member 150 is formed from porous fabric material 152 with plurality of folds 154 adapted to retain water and liquid soap 230, and release water and liquid soap 230 when main body 110 is squeezed.

Figure 4:
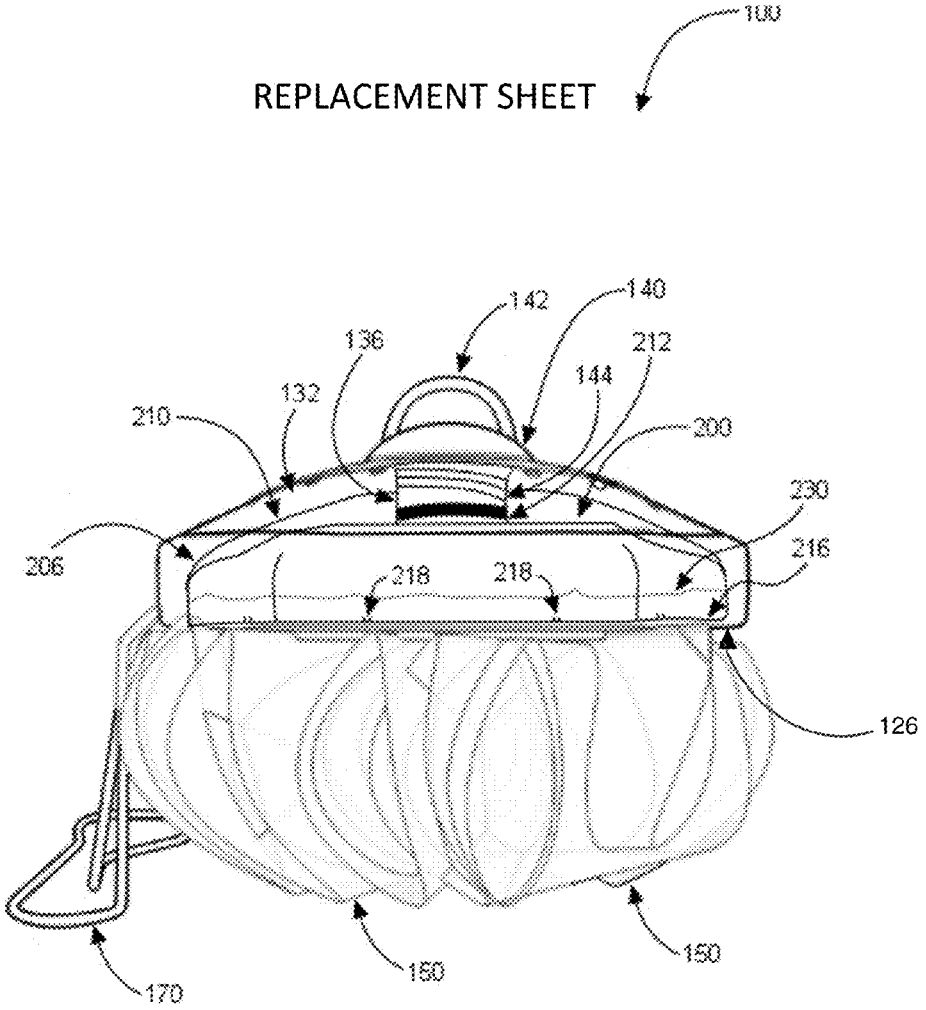
FIG. 4 is a side view illustrating the hollow interior of a main body of an improved sponge apparatus according to an embodiment of the present invention of FIG. 1.

Referring now to FIG. 4, a side view illustrating the hollow interior 132 of a main body 110 of an improved sponge apparatus 100 according to an embodiment of the present invention.

Liquid soap 230 can be placed within liquid soap reservoir 200 via refill cap member 140 having handle member 142 connected thereto via interdigitating threads 144, and when in use, improved sponge apparatus 100 is adapted to allow water to pass through water drain holes 116 of main body 110 and into sponge member 150 while a user squeezes a desired amount of liquid soap 230 out of liquid soap reservoir 200 and into sponge member 150 to mix with water for use. Improved sponge apparatus 100 further has flexible wrist wrap member 170 formed from string material 172, connected to main body 110 and adapted to be placed around a user's wrist when improved sponge apparatus 100 is in use. Main body 110 is formed having an undulated shape 112 around its circumference, making main body 110 easily gripped and squeezed by a user.

Improved sponge apparatus 100 may be manufactured and provided for sale in a wide variety of sizes and shapes for a wide assortment of applications. Upon reading this specification, it should be appreciated that, under appropriate circumstances, considering such issues as design preference, user preferences, marketing preferences, cost, structural requirements, available materials, technological advances or arrangements such as, for example, including more or less components, customized parts, different color combinations, parts may be sold separately, etc., may be sufficient.

Upon reading this specification, it should be appreciated that, under appropriate circumstances, considering such issues as design preference, user preferences, marketing preferences, cost, structural requirements, available materials, technological advances, etc., other methods of use arrangements such as, for example, different orders within above-mentioned list, including or excluding certain maintenance steps, etc., may be sufficient.

The embodiments of the invention described herein are exemplary and numerous modifications, variations and rearrangements can be readily envisioned to achieve substantially equivalent results, all of which are intended to be embraced within the spirit and scope of the invention.

Further, the purpose of the foregoing abstract is to enable the U.S. Patent and Trademark Office and the public generally, and especially the scientist, engineers and practitioners in the art who are not familiar with patent or legal terms or phraseology, to determine quickly from a cursory inspection the nature and essence of the technical disclosure of the application.

What is claimed is new and desired to be protected by Letters Patent is set forth in the appended claims:

1. An improved sponge apparatus comprising:

a resilient main body including:

a top wall including:

a plurality of water drain holes therethrough;

a refill aperture therethrough;

an elongated refill cap member for removably covering said refill aperture;

a bottom wall including:

a plurality of water drain holes therethrough; and a side wall;

wherein said top wall, said bottom wall, and said side wall form a hollow interior therein;

a resilient liquid soap reservoir located within said hollow interior of said main body, said reservoir including:

a top wall including:

a refill aperture therethrough; wherein said elongated refill cap member extends downwardly from said refill aperture within said top wall of said main body and connects with said refill aperture of said liquid soap reservoir, to thereby releasably seal said liquid soap reservoir when connected; and a bottom wall including:

at least one exit hole shaped, sized, and adapted to prevent liquid soap from within said reservoir passing therethrough until a user squeezes and deforms said main body and said reservoir thereby forcing a portion of said liquid soap therethrough; and a sponge member:

wherein said sponge member is connected to a bottom surface of said bottom wall of said main body, and is adapted to retain water and said liquid soap therein;

wherein said sponge member is formed from a material adapted to retain water and said liquid soap therein and release water and said liquid soap when in use;

wherein liquid soap can be placed within said liquid soap reservoir and said refill cap member connected thereto; and when in use said improved sponge apparatus being adapted to allow water to pass through said water drain holes of said main body and into said sponge member while a user squeezes a desired amount of liquid soap out of said reservoir and into said sponge member to mix with water for use.

2. The improved sponge apparatus of claim 1, wherein said sponge member is formed from a porous fabric having a plurality of folds therein.

3. The improved sponge apparatus of claim 1, wherein said main body and said liquid soap reservoir are formed from rubber.

4. The improved sponge apparatus of claim 1, wherein said refill cap member and said refill aperture of said liquid soap reservoir are connected via interdigitating threads thereon.

5. The improved sponge apparatus of claim 1, further comprising a flexible wrist wrap member connected to said main body and adapted to be placed around a user's wrist when said improved sponge apparatus is in use.

6. The improved sponge apparatus of claim 5, wherein said flexible wrist wrap member is formed from a string material.

7. The improved sponge apparatus of claim 1, wherein said refill cap member includes a handle member on a top surface thereof.

8. The improved sponge apparatus of claim 1, wherein said main body is formed having an undulated shape around its circumference adapting said main body to be more easily gripped and squeezed by a user.

9. The improved sponge apparatus of claim 1, further comprising liquid soap placed with said liquid soap reservoir.

* * * * *